United States Patent [19]

Nicely et al.

[11] Patent Number: 5,056,267

[45] Date of Patent: Oct. 15, 1991

[54] BRUSH FINISHING METHOD AND APPARATUS

[75] Inventors: Gerald W. Nicely, Romeo; Steven R. Lipple, Troy; Dennis G. Schmalzel, Almont, all of Mich.

[73] Assignees: Omni Engineering, Inc., Troy; General Motors Corporation, Detroit, both of Mich.

[21] Appl. No.: 434,369

[22] Filed: Nov. 13, 1989

[51] Int. Cl.[5] ..... B24B 49/00

[52] U.S. Cl. ..... 51/165.9; 51/80 A; 51/99

[58] Field of Search ..... 51/80 A, 72 R, 74 R, 51/76 R, 99, 165.9, 334, 266, 267, 327

[56] References Cited

U.S. PATENT DOCUMENTS

| | | | |
|---|---|---|---|
| 2,680,938 | 6/1954 | Peterson | 51/266 |
| 3,237,348 | 3/1966 | Block | 51/74 |
| 4,646,479 | 3/1987 | Walker et al. | 51/334 |

*Primary Examiner*—Maurina Rachuba

*Attorney, Agent, or Firm*—Barnes, Kisselle, Raisch, Choate, Whittemore & Hulbert

[57] ABSTRACT

A method and apparatus for polishing the surface of successive automotive vehicle bodies as they move past a polishing station. Rotary brushes are moved into brushing contact with an automotive vehicle body under a regulated pressure. The brushes have bristles covered with abrasive particles. The bristles are made of a consumable material such as nylon so that the tips wear away during use and fresh abrasive is continually presented for polishing.

10 Claims, 5 Drawing Sheets

BRUSH FINISHING METHOD AND APPARATUS

This invention relates to a brush finishing method and apparatus, and more particularly to a method and apparatus for abrasively treating the surfaces of a plurality of automotive vehicle bodies one after another as they move past a treating station.

In the processing of the surface of an automotive vehicle body, it is desirable to polish or sand the bare metal before painting. This sanding or polishing treatment provides better paint flow characteristics and improved paint adhesion. The painted surface will also have better corrosion resistance and less chipping due to reduced friction of paint application.

The bare metal of an automotive vehicle body has numerous superficial scratches and nicks and other minor defects which are hidden or removed by relatively light sanding. There are, in addition, inevitably deeper scratches and dents which must be corrected by special treatment prior to the painting operation, but the bare metal is so dull that these defects are difficult to detect. Preliminary sanding of the bare metal polishes the metal to highlight these deeper defects for easy detection. Preliminary sanding also has a leveling effect on the usual "orange peel" character of the surface.

Heretofore, the sanding or polishing operation has been performed by hand or by apparatus which is either slow, cumbersome or costly. Examples of prior art methods and apparatus are disclosed in the following U.S. Patents:

Shaffer: U.S. Pat. No. 3,803,776
Block: U.S. Pat. No. 3,237,348
Howard: U.S. Pat. No. 1,937,820
Vargo: 1,807,765

It is an object of this invention to provide a brush finishing method and apparatus which is speedier and less costly and more efficient than heretofore known and which overcomes the deficiencies of prior practices.

It is a further object of this invention to provide a novel brush construction capable of more effectively highlighting the deep scratches and dents in the surface so that such defects may be detected and corrected by special treatment prior to painting.

Another object is to provide a system for applying a lubricant (water) to the vehicle body surface as it is being brushed and polished.

Another object is to provide a system of brush pressure control whereby the force of the brush or brushes against the vehicle body surface can be closely regulated.

These and other objects of the invention will become more apparent as the following description proceeds, especially when taken with the accompanying drawings.

DETAILED DESCRIPTION

Figure 1:
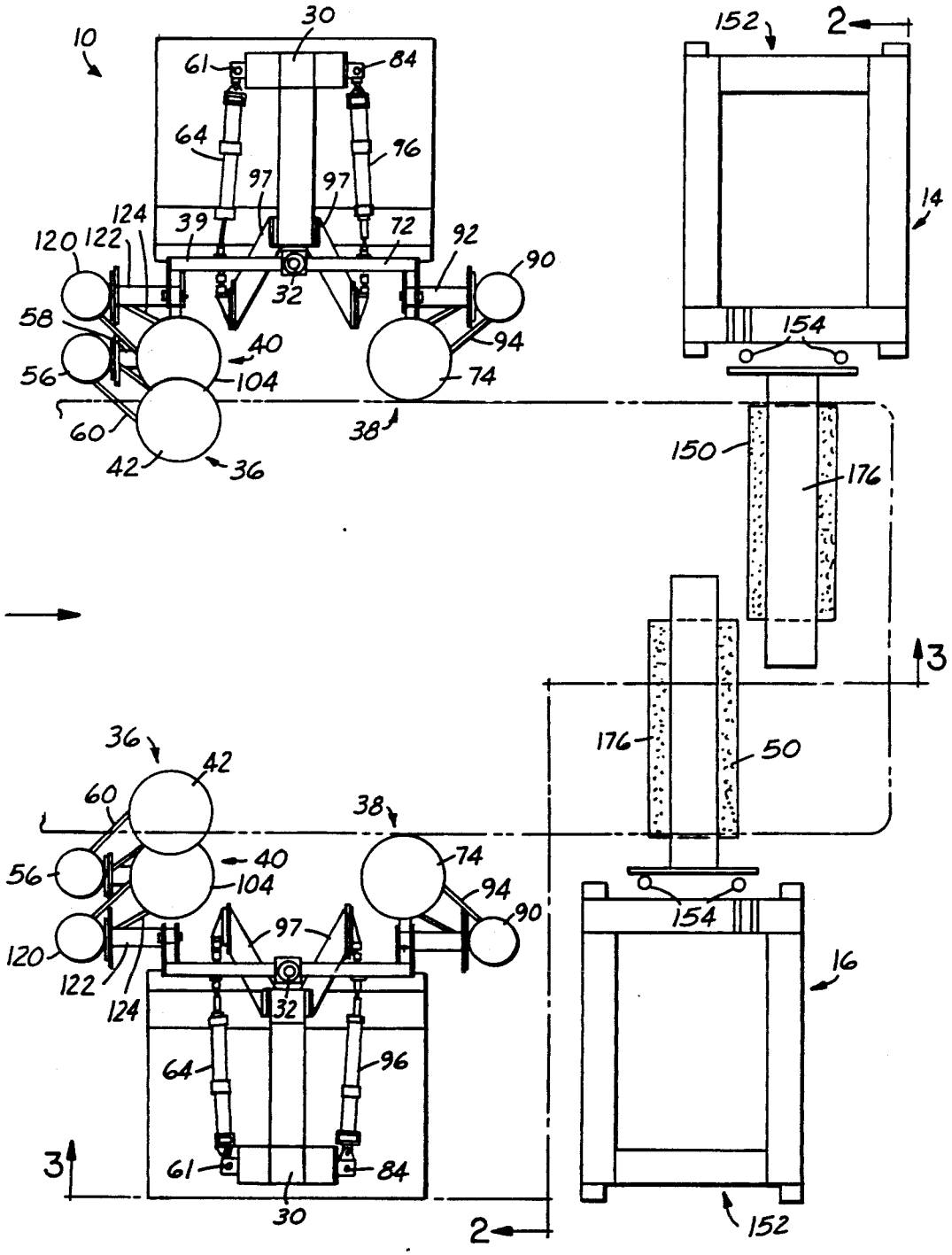
FIG. 1 is a semi-diagrammatic top view of apparatus constructed in accordance with this invention.

Referring now more particularly to the drawings, the apparatus comprises brushing stands 10, 12, 14, and 16 located at a polishing station 18 past which a plurality of automotive vehicle bodies V are transported, one after the other, along a path in the direction of the arrow 19 by any suitable mechanism, not shown.

The stands 10 and 12 are spaced apart laterally and are disposed on opposite sides of the path of movement of the vehicles. The stands 14 and 16 are located alongside the respective stands 10 and 12 and are also spaced apart laterally and disposed on opposite sides of the vehicle body path.

These brush stands have rotary brushes which are adapted to contact and polish the surfaces of the vehicle bodies as they move past the station 18.

The brush stands 10 and 12 are mirror images of one another and have component parts which are identified by the same reference characters. These stands 10 and 12 each have an upright supporting structure 30. A vertical cylindrical rod 32 is affixed at its ends to brackets 34 near the top and bottom of the support structure 30. Brush assemblies 36, 38 and 40 are mounted on rod 32.

Figure 5:
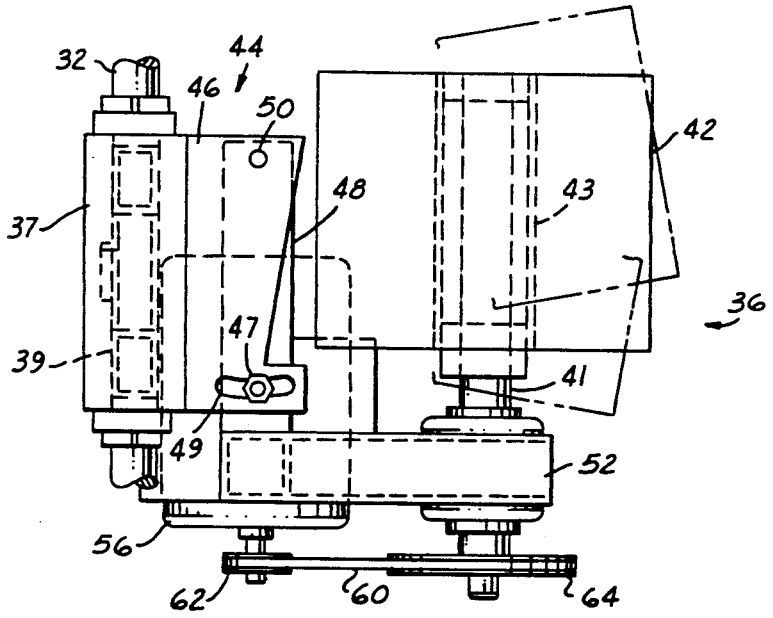
FIG. 5 is an enlargement of another portion of the structure shown in FIG. 2.

Referring to FIG. 5, the brush assembly 36 includes a sleeve 37 rotatably mounted on the rod 32 near the top thereof. An arm 39 has one end secured to the sleeve 37 and extends radially outwardly from the sleeve. A rotary brush 42 is mounted on the outer end of the arm 38 by a bracket assembly 44. The bracket assembly 44 has two parts 46 and 48, the part 46 being rigidly affixed to arm 39. The bracket part 48 is pivoted to bracket part 46 by a pin 50. The angular position of the parts relative to one another is determined by a nut and bolt assembly 47 which is carried by bracket part 48 and extends through an arcuate slot 49 in part 46. The arcuate slot 49 is centered on the pin 50. When the nut and bolt assembly is tightened, the angular relationship of the bracket parts is set.

Figure 2:
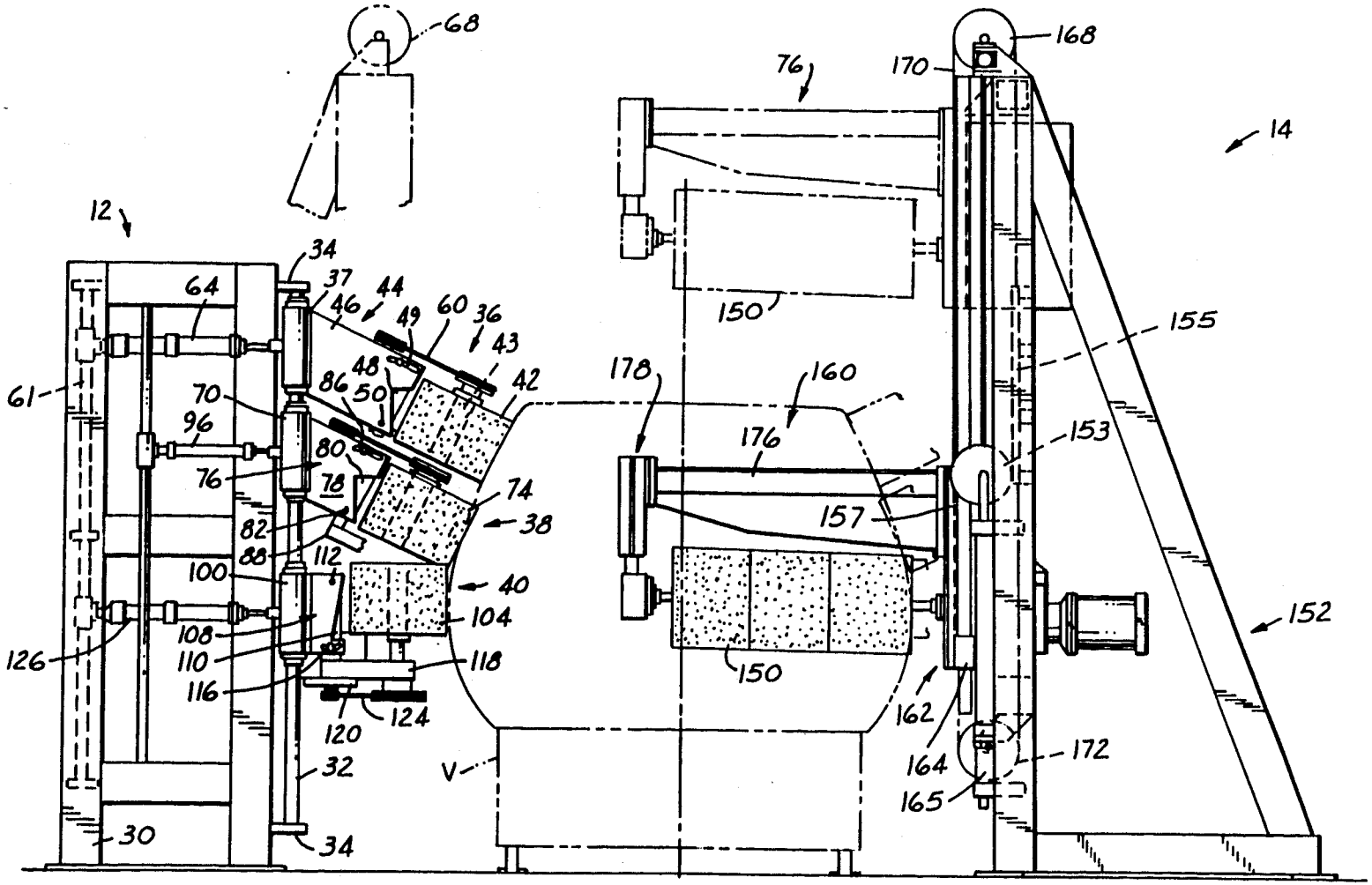
FIG. 2 is a view taken on the line 2—2 in FIG. 1.
Figure 3:
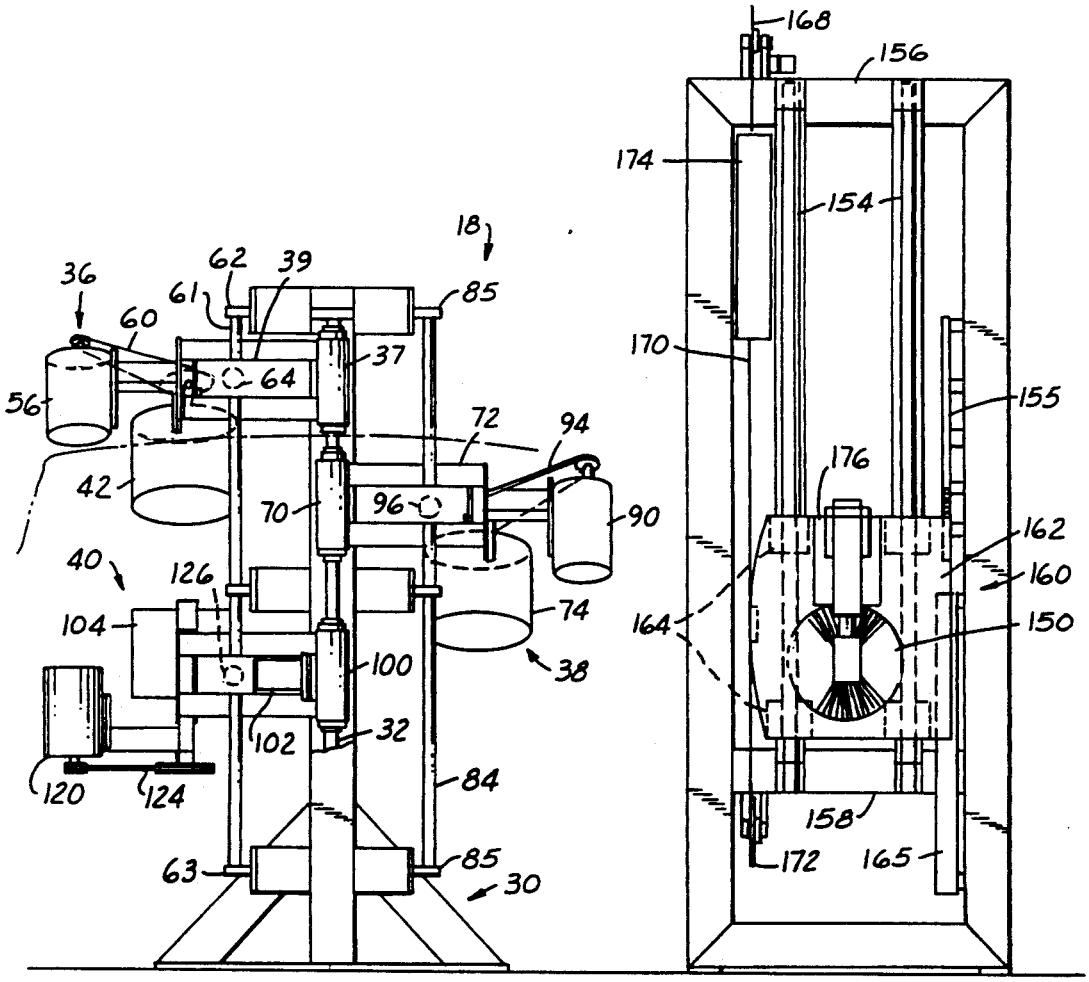
FIG. 3 is a view taken on the line 3—3 in FIG. 1.
Figure 4:
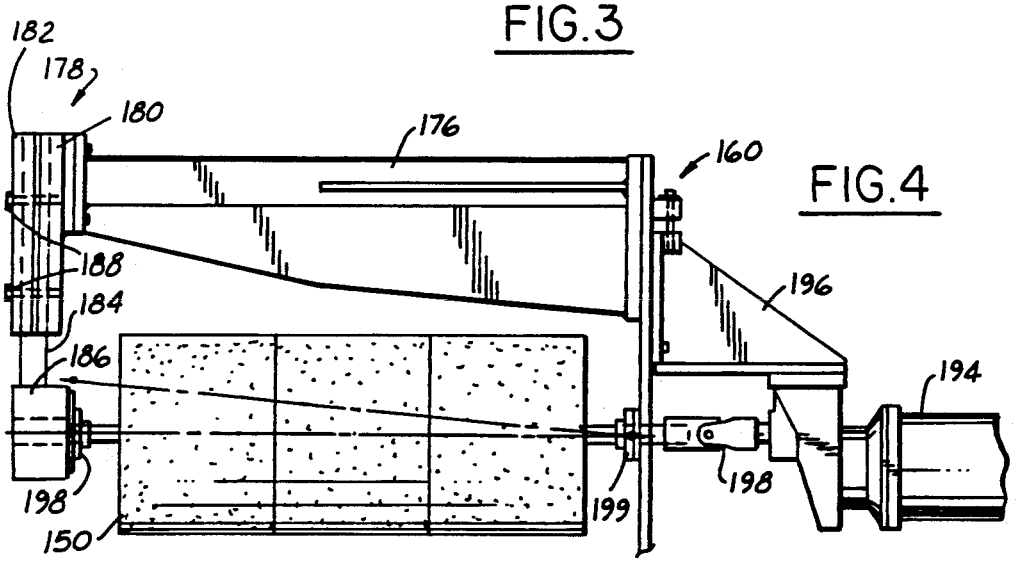
FIG. 4 is an enlargement of a portion of the structure shown in FIG. 2.

The bracket part 48 has an arm 52 which rotatably supports the shaft 41 of brush 42. A motor 56 is mounted on an extension 58 of bracket part 48. The motor 56 rotates the brush 42 by means of a chain or belt 60 which extends around sprockets or sheaves 62 and 64 on the output shaft of the motor and on the shaft 41 of brush 42. As seen in FIG. 2, the brush 42 of stand 10 is positioned and oriented to engage the inclined upper portion of a side of the vehicle near the top. The brush 42 of the opposite stand 12 is similarly positioned and oriented.

A vertical rod 61 is secured at its ends to brackets 62 and 63 near the top and bottom of the frame structure 30. A piston-cylinder assembly 64 is pivoted to rod 61 and to arm 39 to swing brush 42 toward and away from a vehicle body V.

The brush assembly 38 includes a sleeve 70 rotatably mounted on the rod 32 beneath sleeve 37. An arm 72 has one end secured to the sleeve 70 and extends radially outwardly from the sleeve. A rotary brush 74 of substantially the same construction as brush 42 is mounted on the outer end of the arm 72 by a bracket assembly 76. The bracket assembly 76 has two parts 78 and 80, the part 78 being rigidly affixed to sleeve 70. The bracket part 80 is pivoted to bracket part 78 by a pin 82. The angular position of the parts is determined by a nut and bolt assembly which is carried by bracket part 78 and extends through an arcuate slot 86 in bracket part 78. The arcuate slot is centered on the pin 82. When the nut and bolt assembly is tightened, the angular relationship of the bracket parts is set.

The bracket part 80 has an arm 88 which rotatably supports the shaft of brush 74. A motor 90 is mounted on an extension 92 of bracket part 80. The motor 90 rotates brush 74 by means of a chain or belt 94 which extends around sprockets or sheaves on the output shaft of the motor and on the shaft of brush 74. The motor 90 has been omitted in FIG. 2 for clarity. The brushes 74 of the two stands 10 and 12 are adapted to engage the sloping sides of the vehicle body just below the point where brushes 42 engage, and at a similar, although not necessarily the same, angle.

A vertical rod 84 is secured at its ends to brackets 85 near the top and bottom of each frame structure 30. A piston-cylinder assembly 96 is pivoted to rod 84 and to arm 72 of each stand 10, 12 to swing the brushes 74 toward and away from a vehicle body V.

The brush assembly 40 includes a sleeve 100 rotatably mounted on rod 32 beneath sleeve 70. An arm 102 has one end secured to the sleeve 100 and extends radially outwardly from the sleeve. A rotary brush 104 of substantially the same construction as brushes 42 and 74 is mounted on the outer end of the arm 102 by a bracket assembly 106. The bracket assembly 106 has two parts 108 and 110, the part 108 being rigidly affixed to sleeve 100. The bracket part 110 is pivoted to bracket part 108 by a pin 112. The angular position of the bracket parts is determined by a nut and bolt assembly which is carried by bracket part 108 and extends through an arcuate slot 116 in the bracket part 110. The arcuate slot is centered on pin 112. When the nut and bolt assembly is tightened, the angular relationship of the bracket parts is set.

The bracket part 110 has an arm 118 which rotatably supports the shaft of brush 40. A motor 120 is mounted on an extension 122 of bracket part 110. The motor 120 rotates the brush 104 by means of a chain or belt 124 which extends around the sprockets or sheaves on the output shaft of the motor and the shaft of the brush. The brushes 104 of the two stands 10 and 12 are adapted to engage the sides of the vehicle body below the brushes 74.

A piston-cylinder assembly 126 is pivoted to rod 61 and to arm 102 of each stand 10, 12 to swing the brushes 104 toward and away from a vehicle body V.

Shock brackets 97 mounted on support structure 30 may be provided for the brush assemblies 36, 38 and 40, if desired. Shock brackets 97 have resilient pads 98 engaging the arms 39, 72 and 102 in opposition to the piston-cylinder assemblies 64, 96 and 126.

Figure 6:
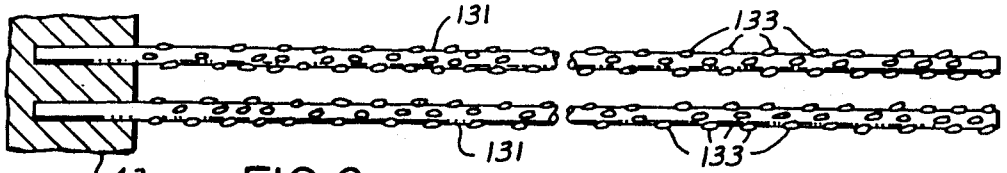
FIG. 6 is an enlarged fragmentary detail showing the bristle construction and also illustrating the manner in which the bristles are attached to the brush core.

The brushes 42, 74 and 104 are of identical construction. Each has an elongated center core 43 of uniform circular cross-section. A plurality of elongated, flexible bristles 131 (FIG. 6) are secured at one end in sockets in the peripheral surface of the core and project radially outwardly therefrom. The bristles are densely packed together although they are free of attachment to one another. The bristles are of substantially the same length so that their tips define a substantially cylindrical brushing surface.

A multiplicity of abrasive particles 133 are secured to and distributed over the surfaces of the bristles throughout substantially their entire length to and including the outer tips thereof.

The bristles are made of a consumable material, preferably nylon, such that the tips of the bristles wear away after continued abrasive contact with the surfaces of the vehicle bodies. In this way fresh abrasive is continually presented for polishing, even though the brush diameter will gradually decrease as the ends or tips of the bristles wear and fall away.

The abrasive particles are of any suitable abrasive material, preferably aluminum oxide. While dimensions may vary, excellent results have been achieved by using brushes in which the bristles are about 4.5 inches in initial length, have a diameter of about 0.021 inches, and in which the overall diameter of the brush including core and bristles initially is about 15 inches.

Each of the stands 14 and 16 has a rotary brush 150 which is adapted to contact the surfaces of vehicle bodies as they move past the polishing station. The brushing stands 14 and 16 are of identical construction and have component parts which are identified by the same reference characters. These stands 14 and 16 each have an upright supporting structure 152. A pair of laterally spaced vertical guide rods 154 are affixed at the ends to cross members 156 and 158 of the supporting structure. The brush assembly 160 of each of the stands 14 and 16 is mounted on the guide rods 154 for vertical movement. More specifically, the brush assembly 160 includes a carrier 162 having sleeves 164 which slidably receive the guide rods to enable the carrier to move up and down on the rods.

A piston-cylinder assembly 165 is secured in upright position on the frame structure 152 of each stand 14, 16. The piston rod of this assembly carries a gear 153 which meshes with a vertical rack 155 on the frame structure 152 and with a rack 157 on the carrier 162 so that carrier movement is twice the piston stroke. In this way, the brush 150 of each stand 14, 16 is moved up and down toward and away from a vehicle body V.

A chain 170 extends over a gear 168 rotatably mounted at the top of the frame structure and over a gear 172 rotatably mounted at the bottom of the frame structure. The ends of the chain 170 are secured to the carrier 162. A counterweight 174 is attached to the course of the chain opposite to the course to which the carrier 162 is attached.

The brush assembly 160 has a cantilever arm 176 which is secured at one end to the upper portion of the carrier 162 and projects over the path of the moving vehicle bodies. A clamp 178 on the outer end of the arm has a fixed part 180 attached to the arm, and a movable part 182. These clamp parts have confronting recesses for frictionally gripping the stem 184 of a bracket 186 when the fasteners 188 connecting the clamp parts are tightened. The bracket 186 rotatably supports the outer end of the shaft extension of the brush 150. The shaft extension on the other end of the brush is operatively connected to the motor 194 which is mounted on a bracket 196 secured to the carrier 162. More specifically, the bracket 186 pivotally supports a bushing 198 which rotatably receives the shaft extension on the outer end of the brush. The shaft extension on the inner end of the brush is rotatably received in a bushing 199 secured to the carrier 162, which bushing likewise is pivotally mounted. These pivotal mounts for the ends of the core enable the brush to be disposed horizontally or to be shifted as much as 5 degrees from the horizontal by raising and lowering the bracket 186 and securing it in adjusted position by means of the clamp 178 on the outer end of the contilever arm. The connection of the shaft extension on the inner end of the brush to the output shaft of motor 194 is by means of a universal coupling 198.

The brushes 150 of stands 14 and 16 are of substantially the same construction as the brushes 42, 74 and 104 previously described, except of greater length. The core diameter and overall brush diameter including bristles is substantially the same, and the bristles and abrasive particles are substantially the same.

Figure 7:
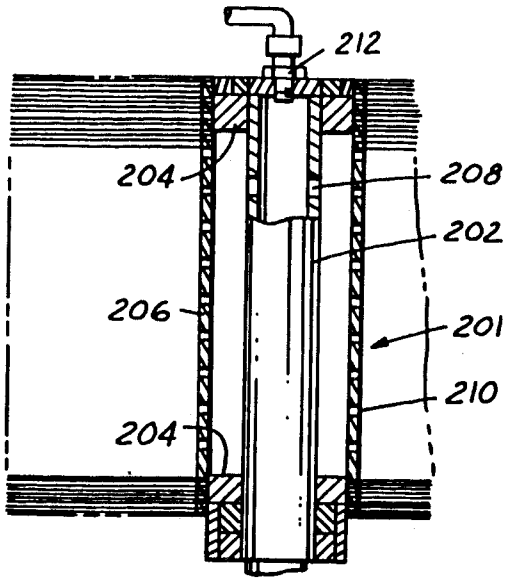
FIG. 7 is a sectional view of a brush of modified construction for wet sanding, in which a lubricant such as water is suppled to the bristles through passages in the brush core.

FIG. 7 shows a modification of the core of one of the brushes 42. The core 201 has an inner tube 202 supported by rings 204 within an outer tube 206. The inner tube has ports 208 leading to the space between the tubes. The outer tube has ports 210 leading to the bristles secured to the outer surface of the outer tube. Liquid lubricant, usually water, is supplied under slight pressure to the space within the inner tube through a fitting 212. In this way, the liquid lubricant is supplied to and coats the bristles for wet sanding. The other brushes 74 and 104 may be similarly modified.

Figure 8:
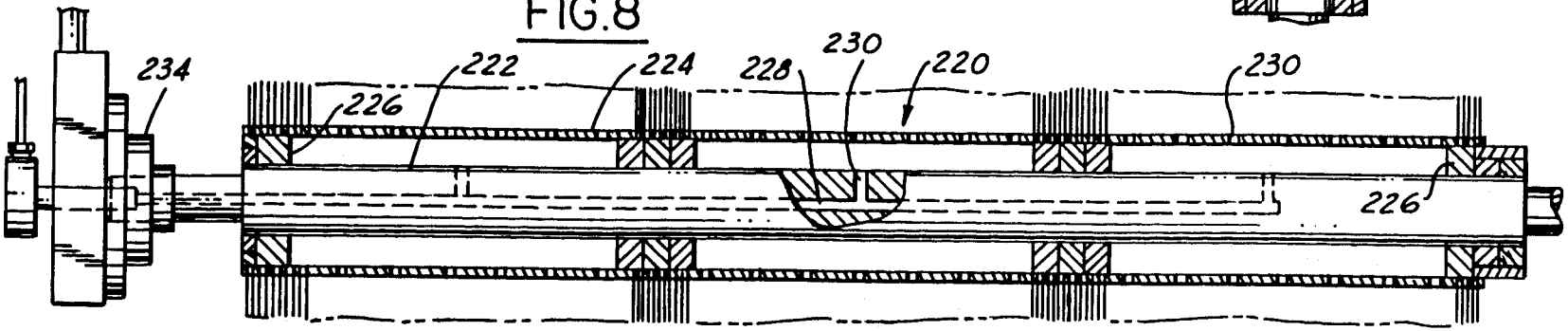
FIG. 8 is similar to FIG. 7 but shows a brush of a different construction, also for wet sanding.

FIG. 8 shows a modification of one of the brushes 150. The core 220 has an inner shaft 222 supported within an outer tube 224 by rings 226. The shaft has a longitudinal passage 228 from which ports 230 lead to the space between the shaft and the outer tube. The outer tube has ports 232 leading to the bristles secured to the outer surface of the outer tube. A liquid lubricant, usually water, is supplied under slight pressure to the longitudinal passage 228 in the shaft 222 by a fitting 234. In this way, the liquid lubricant is supplied to and coats the bristles for wet sanding.

Figure 9:
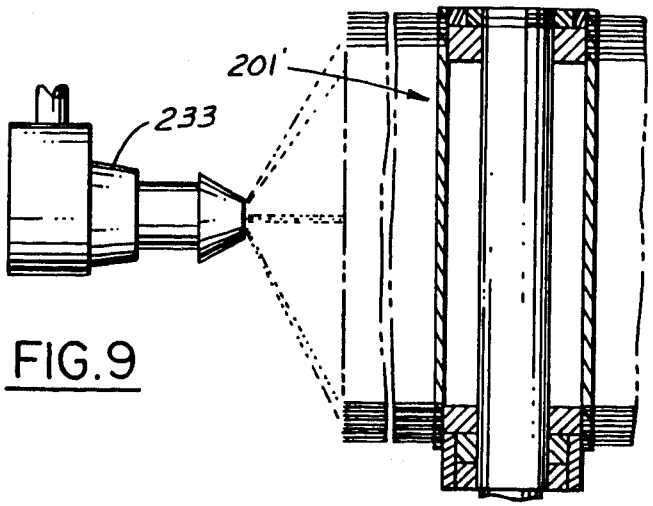
FIG. 9 shows a still further modification for wet sanding in which water or other lubricant is applied to the brush bristles by means of an external spray head.

FIG. 9 shows another brush modification for wet sanding in which a core 201' like that shown in FIG. 7 is provided, but without ports. A liquid lubricant, such as water, is sprayed on the brush bristles by a distributor head 233. This modification is applicable to all of the brushes.

Figure 10:
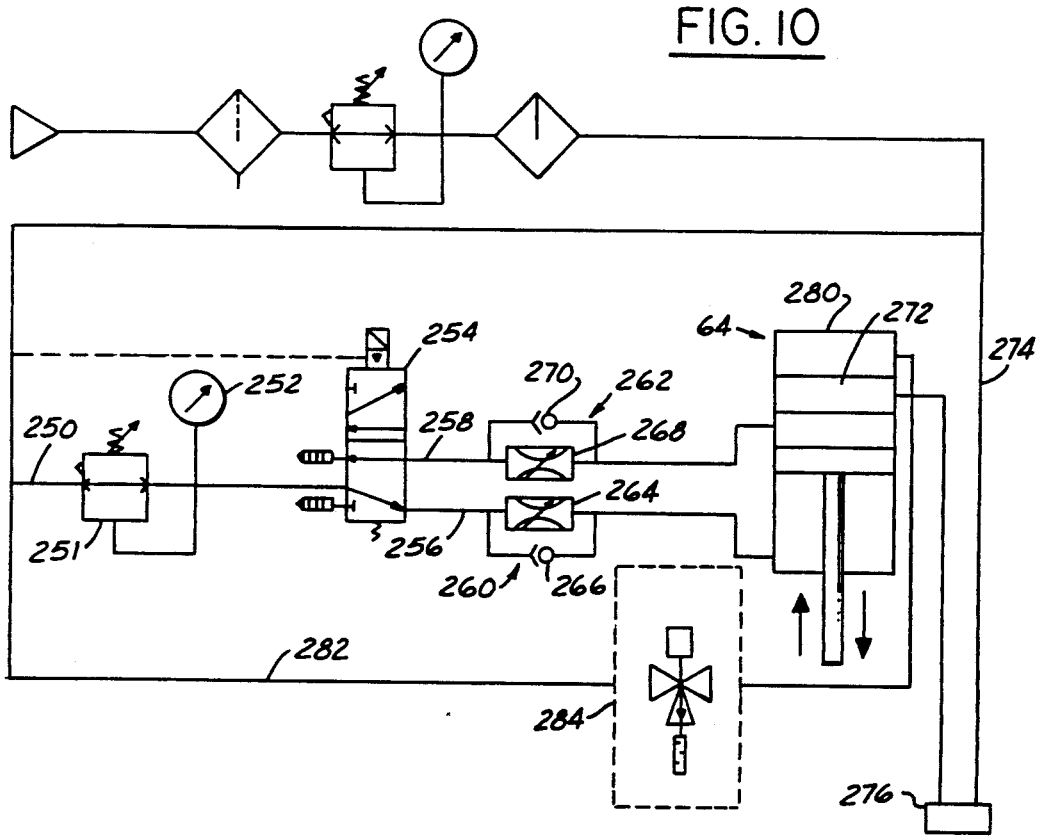
FIG. 10 is a diagram showing a portion of a pneumatic panel for controlling the cylinder assembly for one of the brushes.

The piston-cylinder assemblies 64, 96 and 126 are preferably of the air/hydraulic type in which the oil cylinder is concentric with the air cylinder. Piston-cylinder assemblies of this type operate smoothly in both directions and with the precise control of a purely hydraulic system, but require only plant air to operate. Since the operation and control of these cylinder assemblies 64, 96 and 126 may be substantially the same, only the cylinder assembly 64 for one of the brushes 42 will be described with reference to FIG. 10.

Plant air is supplied to the piston cylinder assembly 64 by line 250 through an adjustable pressure regulator 251 and gage 252, and a 4-way, two position, solenoid controlled valve 254. Regulator 251 maintains the pressure of air to the piston-cylinder assembly 64 within a predetermined range. There are two fluid lines 256 and 258 leading from the valve 254. Line 256 communicates with the rod end of the cylinder assembly 64. Line 258 communicates with the head end. Flow controls 260 and 262 are provided in the respective lines 256 and 258. Flow control 260 has a restriction 264 and a by-pass 266 around the restriction. Flow control 262 has a restriction 268 and a by-pass 270 around the restriction.

When the valve 254 is in the position shown, air under pressure enters the rod end of the cylinder assembly 64 through the by-pass 266, and exits the head end through the restriction 268. This produces a flow of oil in the oil cylinder in one direction for a relatively slow retraction of the brush.

When the valve 254 is moved to the other position, air under pressure enters the head end of the cylinder assembly 64 through the by-pass 270 and exits the rod end through the restriction 264. This produces a flow of oil in the opposite direction for a relatively slow advance of the brush into contact with the vehicle. The pressure of the brush against the vehicle body is determined by the adjustable pressure regulating valve.

A skip control 272 in the cylinder assembly 64 is operated by plant air through line 274. The skip control is provided in emergency situations or whenever it is desired to by-pass the pressure regulating valve and the flow controls and cause a rapid flow of oil from one end of the cylinder to the other and a corresponding rapid retraction of the brush. To rapidly retract the brush, valve 276 is opened to supply plant air under pressure through line 274 to the skip control. Under normal conditions, however, plant air to the skip control is cut-off by valve 276.

A stop control 280 in the cylinder assembly 64 is operated by plant air through line 282. A normally closed valve 284 is in line 282. To override the pressure regulating valve and the flow control 262 and lock the brush in a given position, the valve 284 is opened to supply plant air to the stop control 280. This stop control may be used during the brushing of a vehicle body moving past the treating station when the brush would otherwise drop into a low spot or vacant area such as a window opening. The brush is not retracted but remains locked in a position for brushing upon further movement of the vehicle body through the treating station.

It will be understood that similar fluid power arrangements are provided for the other brushes 74 and 104.

What is claimed:

1. Apparatus for polishing the surfaces of successive automotive vehicle bodies moving past a polishing station, comprising supporting structure adjacent said station, a rotary brush, means mounting said brush on said supporting structure for movement toward and away from an automotive vehicle body as it moves past said polishing station, means for rotating said brush, fluid pressure operated means for advancing said brush toward the automotive vehicle body into pressure contact therewith and for retracting said brush away from the automotive vehicle body, means for supplying fluid under pressure to actuate said fluid pressure operated means and including flow control means for restricting the flow of such fluid and hence retarding operation of said fluid pressure operated means and correspondingly reducing the rate of movement of said brush, and a skip control for by-passing said flow control means when said fluid pressure operated means is retracting said brush to effect a more rapid operation of said fluid pressure operated means and consequently a more rapid retraction of said brush.

2. Apparatus as defined in claim 1, including an adjustable pressure regulator for maintaining the pressure of the fluid supplied to said fluid pressure operated means within a predetermined range to control the pressure with which said brush contacts said automotive vehicle body.

3. Apparatus as defined in claim 1, wherein said fluid pressure operated means is a piston-cylinder assembly operable in one direction to advance said brush and in the opposite direction to retract said brush, a first fluid line leading to one end of said piston-cylinder assembly, a second fluid line leading to the opposite end of said piston-cylinder assembly, valve means selectively operable to connect said fluid pressure supply means to said first lien to operate said piston-cylinder assembly in said one direction during which time fluid is expelled from said piston-cylinder assembly through said second line or to connect said fluid supply means to said second line to operate said piston-cylinder assembly in said opposite direction during which time fluid is expelled from said piston-cylinder assembly through said first line, said flow control means having a restriction in each of said first and second lines and a by-pass around each restriction operative on fluid only as it is being expelled from said piston-cylinder assembly.

4. Apparatus as defined in claim 3, including an adjustable pressure regulator for maintaining the pressure of the fluid supplied to said fluid pressure operated means within a predetermined range to control the pressure with which said brush contacts said automotive vehicle body.

5. Apparatus as defined in claim 4, including a stop control operable when said brush is in contact with the automotive vehicle body to override said adjustable pressure regulator and lock said fluid pressure operated means and hence said brush in a given position so that said brush is incapable either of advancing or retracting and will maintain its position relative to the moving automotive vehicle body while passing over a low spot or vacant area such as a window opening in the automotive vehicle body.

6. Apparatus as defined in claim 1, wherein said brush has a plurality of elongated, flexible bristles projecting radially outwardly from the axis of rotation thereof, and a multiplicity of abrasive particles carried by and distributed over the surfaces of said bristles from the tips at the outer ends thereof along a substantial portion of their length, said bristles being made of a consumable material such that the tips of said bristles wear away during use and fresh abrasive is continually presented for polishing.

7. Apparatus as defined in claim 6, wherein said brush comprises a core having a peripheral surface from which the inner ends of said bristles project, means for supplying liquid to said bristles during rotation of said brush, said liquid supplying means comprising a liquid passage in said core and ports leading from said passage through said peripheral surface of said core, and means for delivering said liquid to said passage for discharge through said ports onto said bristles.

8. Apparatus for polishing the surfaces of successive automotive vehicle bodies moving past a polishing station, comprising supporting structure adjacent said station, a rotary brush, means mounting said brush on said supporting structure for movement toward and away from an automotive vehicle body as it moves past said polishing station, means for rotating said brush, fluid pressure operated means for advancing said brush toward the automotive vehicle body into pressure contact therewith and for retracting the same, means for supplying fluid under pressure to actuate said fluid pressure operated means, an adjustable pressure regulator for maintaining the pressure of the fluid supplied to said fluid pressure operated means within a predetermined range to control the pressure with which said brush contact s said automotive vehicle body, and a stop control operable when said brush is in contact with the automotive vehicle body to override said adjustable pressure regulator and lock said fluid pressure operated means and hence said brush in a given position so that said brush is incapable either of advancing or retracting and will maintain its position relative to the moving automotive vehicle body while passing over a low spot or vacant area such as a window opening in the automotive vehicle body.

9. Apparatus as defined in claim 8, wherein said brush has a plurality of elongated, flexible bristles projecting radially outwardly from the axis of rotation thereof, and a multiplicity of abrasive particles carried by and distributed over the surfaces of said bristles from the tips at the outer ends thereof along a substantial portion of their length, said bristles being made of a consumable material such that the tips of said bristles wear away during use and fresh abrasive is continually presented for polishing.

10. Apparatus as defined in claim 9, wherein said brush comprises a core having a peripheral surface from which the inner ends of said bristles project, means for supplying liquid to said bristles during rotation of said brush, said liquid supplying means comprising a liquid passage in said core and ports leading from said passage through said peripheral surface of said core, and means for delivering said liquid to said passage for discharge through said ports onto said bristles.

* * * * *